US005213041A

United States Patent [19]

Kanck

[11] Patent Number: 5,213,041

[45] Date of Patent: May 25, 1993

[54] METHOD AND SYSTEM FOR FUSING PRINTING IMAGE DEPOSITS ON SURFACES OF A PRINTING SUBSTRATE, AND REMOVAL THEREOF FOR RE-USE OF THE SURFACE

[75] Inventor: Asbjorn J. Kanck, Athelstone, Australia

[73] Assignee: Man Roland Druckmaschinen AG, Offenbach-am-Main, Fed. Rep. of Germany

[21] Appl. No.: 889,781

[22] Filed: May 28, 1992

[30] Foreign Application Priority Data

Jun. 28, 1991 [AU] Australia ..... PK6993

[51] Int. Cl.[5] ..... B41C 1/10

[52] U.S. Cl. ..... 101/450.1; 101/467; 101/487

[58] Field of Search ..... 101/467, 466, 465, 450.1, 101/487, 453

[56] References Cited

U.S. PATENT DOCUMENTS

| | | | |
|---|---|---|---|
| 3,153,132 | 10/1964 | Greene | 219/10.75 |
| 3,741,118 | 6/1973 | Carley | 101/451 |
| 3,928,883 | 12/1975 | Gregory et al. | 15/4 |
| 4,057,016 | 11/1977 | Endo et al. | 101/467 X |
| 4,527,032 | 7/1985 | Young et al. | 219/10.43 X |
| 4,718,340 | 1/1988 | Love, III | 101/450.1 X |
| 4,833,486 | 5/1989 | Zerillo | 101/467 X |

FOREIGN PATENT DOCUMENTS

| | | |
|---|---|---|
| 1075300 | 4/1980 | Canada . |
| 0003789 | 9/1979 | European Pat. Off. . |
| 0298580 | 1/1989 | European Pat. Off. . |
| 73769 | 9/1976 | Luxembourg . |

*Primary Examiner*—Edgar S. Burr
*Assistant Examiner*—Stephen R. Funk
*Attorney, Agent, or Firm*—Frishaulf, Holtz, Goodman & Woodward

[57] ABSTRACT

To prepare a re-usable lithographic printing plate for printing, an imaging deposit is projected on the plate surface by jet printing using an ejectable substance containing a heat fusible component. The substance forms an imaging deposit which is fused to the surface of the printing plate (1) using a variable frequency and variable power induction heater (5). After printing the imaging, the deposit can be removed from the surface of the printing plate (1) using the same variable frequency induction heater (5) but transferring heat energy at a higher effective energy level to the fusible substance.

10 Claims, 1 Drawing Sheet

METHOD AND SYSTEM FOR FUSING PRINTING IMAGE DEPOSITS ON SURFACES OF A PRINTING SUBSTRATE, AND REMOVAL THEREOF FOR RE-USE OF THE SURFACE

FIELD OF THE INVENTION

This invention relates to lithographic printing, and in particular relates to the fusing of printing image deposits to the surface of a lithographic printing member and subsequent removal of such printing image deposits from such surfaces at the conclusion of the printing run.

BACKGROUND

It is known to produce printing image deposits on the surface of a lithographic printing member and fix such printing image deposits by the application of heat. In addition, it is known to remove such printing image deposits from such lithographic printing member surfaces at the conclusion of the printing run. Such a process is disclosed in Canadian Patent 1,075,300 of Wright. The Wright disclosure refers to electrostatographic recording to produce a printing image deposit on an electrostatographic recording member, which printing image deposit is subsequently transferred to the surface of a lithographic printing member and heat-fixed thereto. At the completion of the printing run the printing image deposit is removed from the lithographic printing member surface by the combined action of a solvent and friction.

The process of the Wright disclosure has certain disadvantages, of which the most significant is the image removal step, which involves the combined use of a suitable solvent and friction. This is a laborious and time-consuming process which can alter the grain structure of the lithographic surface and affect seriously its water accepting properties. In addition, when such an operation is carried out on-line on the printing press, care must be taken to confine the solvent to the printing member surface and in particular to avoid contamination of the printing ink in the ink fountain of the press. The solvents used are generally environmentally objectionable and some are highly inflammable.

In addition to the foregoing, the usual prior art heat fusion process requires placing of the printing plate in an oven at a suitably raised temperature for a finite time. Such a process step is not suited to an on-line operation, in which instance a heating mantle or similar device may be used to heat the image deposit and fuse such deposit to the surface of the lithographic printing plate. Each of these methods tends primarily to cause coherence of the printing deposit rather than adhesion of the printing deposit to the plate surface.

THE INVENTION

It is an object to overcome the disadvantageous features of the prior art and to provide a system and a method for fusing of printing deposits, in which the fusion occurs outwardly from the plate surface, to cause strong and complete adhesion of the printing deposit to the plate surface, and wherein, in addition, image fusion can be achieved directly in combination with the actual process of image substance deposition. Additionally, the same apparatus; with only minor adjustments to its operating condition, should be able to remove the printing deposits at the end of a printing run, without the use of solvents or of friction.

Briefly, in accordance with the present invention, a reusable lithographic printing surface is prepared by producing an image deposit on the surface of a printing plate, preferably a hydrophilic printing plate, by jet printing with a substance which is ejectable by a customary jet printer, which substance contains a heat fusible component. The substance is then fused to the printing plate by using a heat source, preferably a controllable radio frequency induction heater. The desired number of copies of the fused image deposit on the printing plate surface can then be printed by conventional lithographic printing processes. After printing, the prior printing image deposit can be removed from the printing plate surface, using the same variable frequency induction heater, but providing increased heat energy to the fusible deposit, to melt the fusible deposit. The printing plate is thus made ready for re-imaging and re-use.

DRAWINGS

The single FIGURE illustrates the equipment used to fuse printing image deposits to a printing plate surface and subsequent removal of the image deposits therefrom.

DETAILED DESCRIPTION

Figure 1:
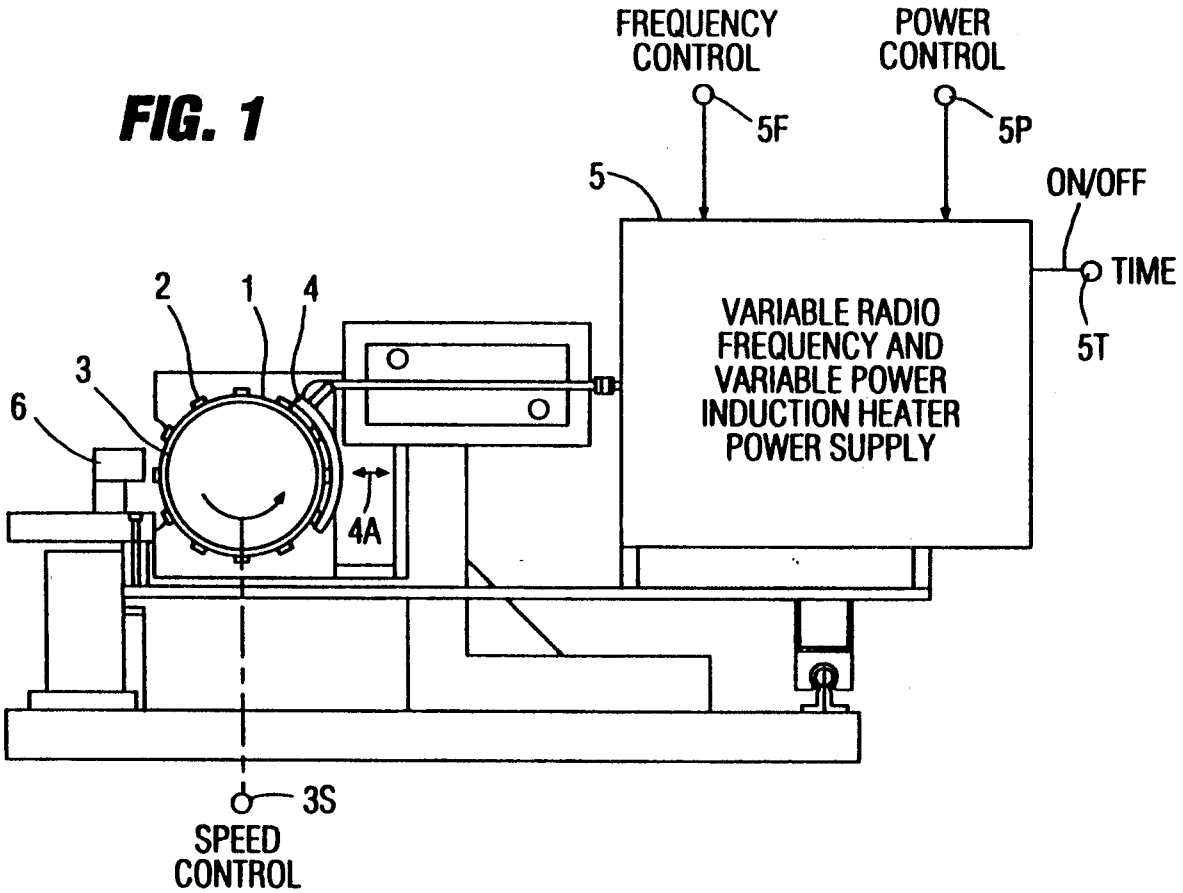

Components used in the present invention will be described in detail. Components not described, such as structural members required for support, traversing and rotation of elements, where applicable, all can be in accordance with known structures and well known engineering design.

A printing plate 1, carrying printing deposits on the outer surface thereof, is attached to the outer surface of a rotatable cylinder 3, for example of steel. Other materials may be used. Curved electrode 4 is mounted facing printing plate 1. The space or gap between the electrode 4 and the printing plate 1 is variable, as schematically indicated in the drawing by the double arrow 4A. The curved electrode 4 is energized by a variable controllable radio frequency induction heater power supply 5. Either or both the printing plate 1 or the cylinder 3 are electrically conductive.

For the purpose of the present invention, it is preferred to produce the printing image by jet printing. An AB Dick video jet is suitable. The jet apparatus 6 uses a jet, which can eject an ejectable substance, similar to jet ink. This substance contains fusible components, as will be described below. The fusing and the image removal steps, to be described in detail below, are independent of the method of image formation and may be used for example in combination with any electrostatographic image formation method, for example as known from the prior art.

In accordance with a feature of the present invention, the high-frequency induction heating power supply 5 feeds the shaped electrode 4, maintained in spaced-apart relationship, that is, with a gap, from the image plate 1. By controlling the power input frequency at control input 5F, the power output at control input 5P, and operating time at control input 5T for the power supply, and/or the rotary speed of cylinder 3 at speed control 3S, it is possible to effect only skin heating of the lithographic printing plate surface and to cause the printing image deposit contained on such surface to be heated virtually from the inside towards its surface remote from the printing plate, so that such printing image deposit will fuse to the surface of the printing plate prior to becoming internally coherent. This obviates bridging or the like which could cause premature failure of the printing image deposit during a printing run. The electrode 4 is mounted such that its spacing or gap from the surface of plate 1 can be varied, as schematically shown by the arrow 4A.

Operation, with reference to the following examples:

EXAMPLE 1

A jet substance was prepared in accordance with the following formulation

| | |
|---|---|
| styrene-maleic anhydride | 12 g |
| ammonia | 5 g |
| bactericide | 2 g |
| dye | 2 g |
| diethylene glycol di-ethyl ether | 30 g |
| water | 949 g |

In this substance, the styrene-maleic anhydride is the heat fusible component. It is soluble in an alkaline aqueous medium. The dye is included merely for production of a visible image deposit to permit visual checking by a press operator. The bactericide and glycol ether are functional components relating to jet printing and are not pertinent to the final printing image deposit.

The printer 6 was an AB Dick video jet printer, using the printing substance of Example 1, to form a printing image deposit on a grained aluminum plate, mounted on the rotatable cylinder 3.

The thus formed printing image deposit was fused to the surface of the printing plate 1 using the variable radio frequency induction heater 5. Power was fed to the curved electrode 4 spaced apart from the image lithographic printing plate surface by a distance of 6 mm. The linear speed of the printing plate 1 with respect to the electrode 4 was 0.5 cm/second. Power supply was 1.5 kW at a frequency of 140 kHz.

The lithographic printing plate 1 with the printing image deposit 2 fused thereto was positioned on an offset printing apparatus, and used to print ten thousand copies of the information contained thereon after damping and inking of the plate.

To reconstitute plate 1, the residual printing ink was removed. The plate 1 was then returned to the fusing apparatus. For removal of the previously inked image deposits, the electrode gap was reduced to 4 mm, and the apparatus 5 energized, This removed the printing image deposit and rendered the lithographic printing plate 1 ready for re-imaging. The smaller gap increased the effective power applied to the plate 1.

EXAMPLE 2

Example 1 was repeated with the change that the power supply was increased to 1.6 kW and operated at a frequency of 150 kHz. For fusing the printing deposits 2, the curved electrode 4 was positioned from the printing plate surface by a distance 6 mm; for removal, the gap or spacing between the electrode 4 and the plate 1 was decreased to 4 mm, to effect image erasure.

EXAMPLE 3

A flat, axially extending electrode was used with its long dimension parallel to the axial direction of the printing plate surface, spaced therefrom by a distance of 5 mm. The power supply was 3 kW, and its frequency 140 kHz. The cylinder containing the printing plate on its outer surface was rotated at a circumferential or surface speed of 1 cm/second for image fusing, and 0.5 cm/second for image erasing.

Both the frequency of the power supply as well as its power output can be controlled and adjusted to change the depth of penetration of heating inwardly into the deposit from the plate surface, and different frequencies and power outputs may be required for different printing surfaces or deposits. Plate cleaning, which theoretically requires more energy than the original image fusing, can be carried out at a higher frequency than fusing to decrease the depth of penetration of heat into the printing plate.

EXAMPLE 4

Example 1 was repeated except that, for removal, the power level of the power supply 5 was raised to 2.2 kW.

The invention as described provides for efficient fusion of printing image deposits, better than the prior art, and further provides an image removal method which does not involve the use of solvents or abrasives, and which does not affect the re-usability of the lithographic printing plate.

I claim:

1. A method of lithographic printing using a reusable lithographic printing plate (1) having an image accepting surface, comprising the steps of;

producing a printing image deposit (2) on the surface of the printing plate (1) by jet printing with a jet printing substance containing a heat fusable component;

fusing said printing image deposit (2) onto the surface of the printing plate, by using a heating means (4, 5) providing for heating of the deposit at a first heat energy level;

printing the desired number of copies of said fused image deposit (2) on the surface of said printing plate (1) by lithographic printing; and removing said printing image deposit (2) from the surface of said printing plate (1) by using said heating means by applying heat energy from said heating means to said deposit at a level which is higher with respect to said first heat energy level.

2. The method of claim 1, wherein the printing plate (1) is a metallic printing plate.

3. The method of claim 1, wherein said heating means is a variable frequency induction heater (5).

4. The method of claim 3, wherein said fusing step and said removing step are carried out by said variable frequency induction heater operating with a power output of about 1.5 kW and a frequency of about 140 kHz.

5. The method of claim 3, wherein said fusing step and said removing step are carried out by said variable frequency induction heater operating with a power output of about 1.6 kW and at a frequency of about 150 kHz.

6. The method of claim 3, wherein said fusing step and said removing step are carried out by said variable frequency induction heater operating at a power output of about 3 kW and a frequency of 140 kHz.

7. The method of claim 1, wherein said step of fusing said printing image deposit (2) comprises;

applying a high-frequency radio wave field at a given energy level to the surface of the printing plate (1) by an electrode (4) spaced from said plate by a first predetermined distance; and said removal step comprises applying said field at approximately said given energy level to said electrode, and spacing said electrode (4) from the plate (1) by a smaller distance than said first predetermined distance.

8. The method of claim 1, wherein said step of fusing said printing image deposits comprises;

applying a high-frequency radio wave field at a given energy level to the surface of the printing plate (1) by an electrode (4) spaced from said plate by a first predetermined distance for a first predetermined time interval at selected discrete areas of the plate; and said removal step comprises applying said field at said given level to said electrode (4) during a time which is longer than said first predetermined time interval.

9. The method of claim 1, wherein said heating means is a variable frequency induction heater;

wherein said step of fusing said printing image deposits comprises;

applying a high-frequency radio wave field at a first energy level to the surface of the printing plate by an electrode spaced from said plate by a predetermined distance for a predetermined time interval; and said removal step comprises applying said field at a second and higher given energy level to said electrode.

10. The method of claim 1, wherein said printing plate (1) is hydrophilic, and said substance is oleophilic, or hydrophobic.

* * * * *